US008360589B2

(12) United States Patent
Friedson

(10) Patent No.: US 8,360,589 B2
(45) Date of Patent: Jan. 29, 2013

(54) CHEMILUMINESCENT ILLUMINATED NOVELTY DEVICE

(75) Inventor: John M. Friedson, Longmeadow, MA (US)

(73) Assignee: Omniglow LLC, West Springfield, MA (US)

( * ) Notice: Subject to any disclaimer, the term of this patent is extended or adjusted under 35 U.S.C. 154(b) by 259 days.

(21) Appl. No.: 12/852,327

(22) Filed: Aug. 6, 2010

(65) Prior Publication Data

US 2012/0033401 A1 Feb. 9, 2012

(51) Int. Cl.
*F21K 2/06* (2006.01)

(52) U.S. Cl. ..... 362/34; 362/101; 362/159; 362/374

(58) Field of Classification Search ..... 362/34, 362/101, 154, 158, 159, 171, 374
See application file for complete search history.

(56) References Cited

U.S. PATENT DOCUMENTS

| | | | | | |
|---|---|---|---|---|---|
| 1,107,645 | A | | 8/1914 | Benedict | |
| 3,539,794 | A | * | 11/1970 | Rauhut et al. | 362/34 |
| 3,818,208 | A | | 6/1974 | Kahl | |
| 4,015,111 | A | * | 3/1977 | Spector | 362/34 |
| 4,409,644 | A | | 10/1983 | Axton | |
| 5,070,437 | A | | 12/1991 | Roberts, Sr. | |
| 5,463,537 | A | | 10/1995 | Trattner | |
| 5,552,968 | A | * | 9/1996 | Ladyjensky | 362/34 |
| 5,697,182 | A | | 12/1997 | Rodgers | |
| 5,860,724 | A | * | 1/1999 | Cheng | 362/34 |
| 5,903,212 | A | | 5/1999 | Rodgers | |
| 6,322,227 | B1 | * | 11/2001 | Liu et al. | 362/34 |
| 6,371,624 | B1 | * | 4/2002 | Dorney | 362/34 |
| 6,416,198 | B1 | | 7/2002 | Vanderschuit | |
| 6,520,657 | B1 | * | 2/2003 | DeNicola | 362/34 |
| 6,685,331 | B1 | * | 2/2004 | Rockwell | 362/34 |
| 6,796,670 | B2 | * | 9/2004 | Winters et al. | 362/34 |
| 6,824,289 | B2 | | 11/2004 | Vanderschuit | |
| 7,063,432 | B2 | | 6/2006 | VanderSchuit | |
| 7,401,935 | B2 | | 7/2008 | VanderSchuit | |
| 7,422,339 | B2 | * | 9/2008 | Jordan | 362/34 |
| 7,487,728 | B2 | * | 2/2009 | Cranor | 362/34 |
| 2008/0273319 | A1 | | 11/2008 | VanderSchuit | |

* cited by examiner

*Primary Examiner* — Ismael Negron
(74) *Attorney, Agent, or Firm* — Levenfeld Pearlstein, LLC

(57) ABSTRACT

A sealed, chemiluminescent novelty device includes a housing having side walls and a bottom wall to define a housing and a lid sealable to the housing. The lid has a flexible membrane with a depending plunger. A sealed charge having side walls and a top wall with a flexible membrane, is positioned in the housing. The charge has an activation post aligned with the membrane. A sealed, frangible ampoule is disposed in the charge. A first chemical is disposed in the charge, outside of the ampoule and a second chemical is disposed in the ampoule. Pressure applied to the housing lid urges contact with the charge top wall to urge the top wall to move the activation post into contact with the ampoule to break the ampoule allowing the first and second chemicals to mix.

20 Claims, 1 Drawing Sheet

CHEMILUMINESCENT ILLUMINATED NOVELTY DEVICE

BACKGROUND OF THE INVENTION

The present invention relates to an illuminated novelty device. More particularly, the present invention relates to a chemiluminescent illuminated novelty device.

There are several illuminated novelty devices commercially available, some of which are in the form of, or resemble beverage accessory devices, such as ice cubes. Two principal types of devices are known, chemically activated devices and electrically activated devices. The chemically activated devices are exemplified by that described in Cheng, U.S. Pat. No. 5,860,724, which includes a chemiluminescent light emitter within a housing shaped like an ice cube. The housing has several chambers each filled with chemicals that when mixed together emit light.

The device in Cheng is a relatively complex construction, with multiple (three) chambers and a thin film or membrane that is needed to maintain the chemicals segregated from one another. In addition, the construction makes mixing the chemicals, following fracture of the film, difficult in that the flow space between the chambers is limited by the area of the film.

In the electrically activated devices, light emitting diodes (LEDs) are typically used to produce light. The LED require a power source, i.e., batteries, that have their inherent drawbacks, such as possibly limited shelf life. One such LED-type construction is illustrated in Vanderschuit, U.S. Pat. No. 6,416,198 and its progeny.

Accordingly, there is a need for a chemically activated or chemiluminescent illuminated novelty device. Desirably, such a device is a beverage accessory device, resembling or shaped much like an ice cube. More desirably still, such a device is readily easy to manufacture with a minimal number of chambers require to maintain the chemicals segregated from one another.

SUMMARY OF THE INVENTION

A sealed, chemiluminescent novelty device includes a sealed outer housing and a sealed charge within the housing. The housing includes side walls and a bottom wall formed as a unitary member to define a housing inner region. A housing lid is sealable to the housing side walls to enclose the inner region.

The housing lid has a flexible membrane and a plunger depending from the membrane. The housing lid is flexible so as to urge the plunger into the inner region. The housing lid flexible membrane can be formed with a living hinge.

The charge has side walls and a top wall formed as a unitary member to define a charge inner region. The charge has centering abutments formed therein.

The charge top wall has a flexible membrane, and an activation post depending from the membrane. The charge top wall is flexible so as to urge the activation post into the charge inner region. The charge top wall and the housing lid are aligned with one another. The charge top wall flexible membrane can be formed with a living hinge.

A charge lid is sealed to the charge side walls to seal the charge and enclose the inner region. The charge abutments are formed integral with the charge side walls and bottom wall.

A sealed, frangible ampoule is disposed in the charge between the centering abutments, the charge lid, and the top wall. A first chemical is disposed in the charge, outside of the ampoule and a second chemical is disposed in the ampoule.

Pressure is applied to the housing lid to urge the housing lid into contact with the charge top wall. Continued pressure on the housing lid urges the charge top wall inward of the charge inner region to move the activation post into contact with the ampoule to break the ampoule to allow the first and second chemicals to mix to provide a chemiluminescent lighting effect. After activation, the chemicals are maintained within the sealed charge.

The housing lid is sealed to the housing side walls by heat sealing, the application of ultrasonic energy to a juncture of the housing lid and the side walls, an adhesive or the like. Similarly, the charge lid is sealed to the charge side walls by heat sealing, the application of ultrasonic energy to a juncture of the charge lid and the side walls, an adhesive or the like.

The housing lid flexible membrane can be formed integral with the housing lid and the charge top wall flexible membrane can be formed integral with the top wall and the charge body.

The charge lid can be formed having a generally U-shaped profile defining free ends of the lid such that the free ends define feet to space the charge from the housing bottom wall.

The housing lid plunger and the charge top wall activation post are aligned with one another to communicate pressure on the housing lid flexible membrane to the frangible ampoule.

The novelty device and be manufactured to resemble or have the shape of a beverage accessory, such as an ice cube.

Other features and advantages of the present invention will be apparent from the following detailed description, the accompanying drawings, and the appended claims.

BRIEF DESCRIPTION OF DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
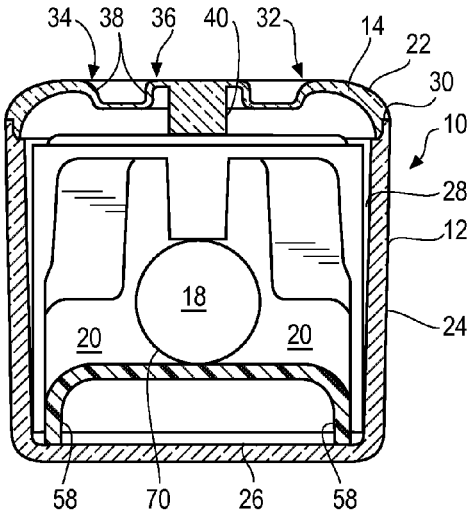
FIG. 1 is a sectional or side view of a chemiluminescent novelty device embodying the principles of the present invention, the device is shown as a beverage accessory device shaped like or resembling an ice cube and having an activator stored in a sealed ampoule.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular to FIG. 1., there is shown a chemiluminescent illuminated novelty device 10. As illustrated, the device 10 is formed as or resembling an ice cube or beverage accessory device. The device 10 includes an outer housing 12 with a housing lid 14 and an inner module or charge 16 that contains the chemicals 18, 20 needed to produce the chemiluminescent lighting effect.

In a present embodiment, the outer housing 12 includes five sides (five of the six sides of a cube), including a top wall 22 and four side walls 24. A bottom side 26 is defined by the lid 14, and encloses the housing 12, creating a liquid-tight enclosure 28. In a present embodiment a seal 30 is formed between the lid 14 and the housing sides walls 24. The seal 30 can be provided by affixing the lid 14 to the side walls 24 by an adhesive, for example, a liquid impervious adhesive, heat sealing, ultrasonic sealing or the like.

The lid 14 includes a movable, hinged portion 32, the purpose of which is discussed in more detail below. The hinged portion 32 is formed by a flexible membrane 34 or the like to define what is commonly referred to as a living hinge indicated at 36. In a present embodiment, the living hinge 36 is formed in an annular configuration about centrally disposed on the lid 14. To permit movement of the membrane 34, the hinge 36 is formed as a flexible S-shaped portion 38 in the flexible membrane 34 to provide sufficient material to effect movement of the hinge 36.

A plunger 40 is disposed within the hinged portion 38, extending inwardly of the housing 12. The plunger 40 can be formed from the same material, and as part of the membrane 34, for ease of manufacture. Alternately, the plunger 40 can be formed from a different material that is adhered to or affixed to the membrane 34 or, for example, formed in a co-extrusion or like process to provide a unitary member of two different materials.

The charge 16 is a self-contained unit that is disposed in the housing 12 and contains the segregated chemicals 18, 20 necessary for producing the chemiluminescent light. Those skilled in the art will recognize the chemicals 18, 20 commonly used to produce such an effect, such as an oxalate and an activator.

In a present embodiment, the charge 16 is constructed similar to the housing 14 and includes a body 42 having five sides (five of the six sides of a cube), including a top wall 44 and four side walls 46. A bottom side 48 is defined by a charge lid 50, and encloses the charge 16, creating a liquid-tight enclosure 52. In a present embodiment a seal 54 is formed between the charge lid 50 and the side walls 46. The seal 54 can be provided by affixing the charge lid 50 to the walls 46 by an adhesive, for example, a liquid impervious adhesive, heat sealing, ultrasonic sealing or the like.

Figure 2:
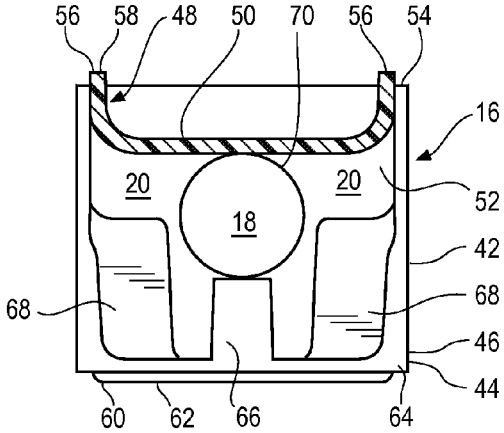
FIG. 2 is a view of the charge portion of the device which encloses the chemicals.

As seen in FIG. 2, the charge lid 50 has a generally U-shaped profile, the free ends 56 of the U-shaped lid defining feet or spacers 58. The feet 58 space the charge 16 in the housing 12 and facilitate centering or positioning the charge 16 within the housing 12.

Also similar to the housing 12, the charge top wall 44 includes a movable or flexible portion 60, the purpose of which is discussed in more detail below. The flexible portion 60 is formed by a flexible membrane 62, diaphragm or the like, to define a living hinge 64. In this manner, the membrane or diaphragm 62 can be flexed inwardly of the charge body 42.

A plunger or activation post 66 is disposed on the diaphragm 62, extending inwardly of the body 42. The post 66 can be formed from the same material, and as part of the membrane 62, for ease of manufacture. Alternately, the post 66 can be formed from a different material that is adhered to or affixed to the membrane 62 or, for example, formed in a co-extrusion or like process to provide a unitary member of two different materials.

Centering wings or abutments 68 are disposed inside of the charge body 42. The abutments 68 can be formed integral with, e.g., as part of the charge body 42, or mounted within the body 42.

A sealed ampoule 70 is positioned within the charge 16. As best seen in FIG. 2, the ampoule 70 is positioned on the activation post 66, and is held in place by the abutments or wings 68. This configuration assures that the ampoule 70 will remain in place, within the charge 16 and that movement of the ampoule 70 is limited once the lid 50 is in place, on the charge 16. In a present embodiment, the ampoule 70 is formed from glass or another frangible, generally liquid impervious material. One of the chemicals 18 necessary for generation of the chemiluminescent effect is contained with the ampoule 70. For example, the oxalate can be contained within the ampoule 70.

The other of the chemicals 20 is contained within the body 42 of the charge 16 and is sealed within the charge 16 by the sealed charge lid 50. In this manner, the chemicals 18, 20 are segregated from one another by the ampoule 70, and both the ampoule 70 and the other of the chemicals 20 are contained within the sealed charge 16.

As seen in FIG. 1, when the charge 16 is positioned in the housing 12, there is a double barrier between the chemicals 18, 20 and the environs. In a present embodiment, the housing 12 is formed from a mixture of polypropylene resin and a polypropylene-based elastomer, such as VISTAMAXX, commercially available from ExxonMobil Chemical Company of Houston, Texas. The charge 16 is formed from a low density polyethylene (LDPE) resin. Those skilled in the art will recognize the various materials from which the housing 12, housing lid 14, charge 16, charge lid 50, and flexible membranes 34, 62 can be form, all such materials being within the scope and spirit of the present invention.

Figure 3:
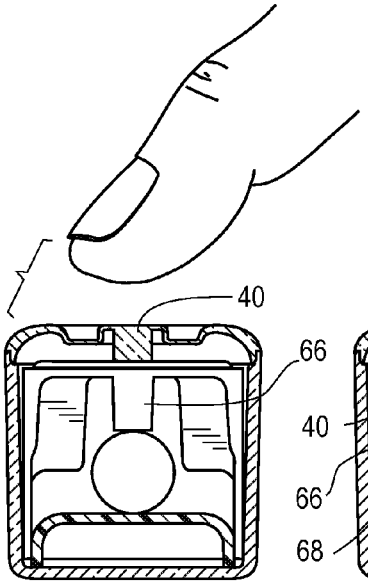
FIG. 3 is an illustration of the device with a user's finger positioned above the device, prior to activation.
Figure 4:
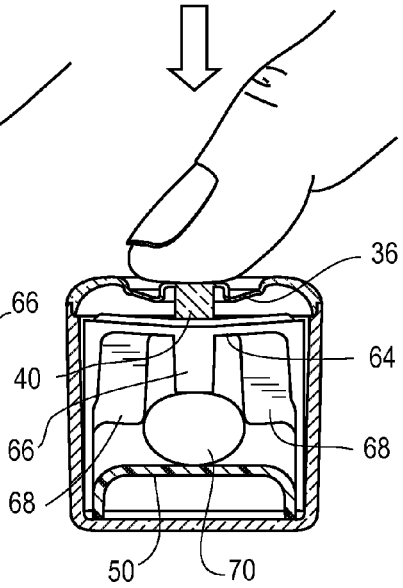
FIG. 4 is an illustration of the device with the user's finger placed on an outer surface of the device, above the activating switch.
Figure 5:
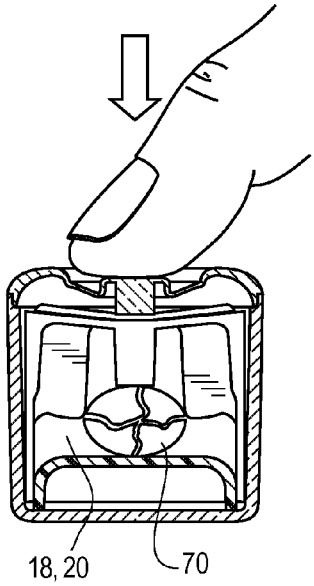
FIG. 5 is an illustration of the user's finger depressing the outer surface and moving the activating switch against the plunger to fracture the ampoule.

Referring to FIGS. 3-5, activation of the device 10 is straight-forward. A user places a finger on the housing lid 14 and depresses the flexible, hinged portion 32 of the lid 14. Urging the plunger 40 downward (into the housing 12), moves the plunger 40 into contact with the charge membrane 62, which in turn urges the activation post 66 into contact with the ampoule 70. With sufficient force against the flexible, hinged portion 32 and consequently against the activation post 66, the activation post 66 will contact and break the ampoule 70. This will result in the chemicals 18, 20 being in intimate contact with one another. Because the ampoule 70 will break and shatter, there is a relatively large flow path and mixing chamber formed within the charge body 42. This makes is quite easy to mix the chemicals 18, 20 with one another (merely by shaking the device 10), to produce the chemiluminescent effect.

It will be appreciate by those skilled in the art that although the device 10 is shown and described as a beverage accessory device or ice cube, the device 10 may take other forms and shapes and that such other forms and shapes are within the scope and spirit of the present invention.

All patents referred to herein, are incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A sealed, chemiluminescent novelty device, comprising:

a housing having side walls and a bottom wall formed as a unitary member to define a housing inner region;

a housing lid sealable to the housing side walls enclose the inner region, the housing lid having a flexible membrane, the housing lid having a depending plunger thereon, the housing lid being flexible so as to urge the plunger into the inner region;

a charge having side walls and a top wall formed as a unitary member to define a charge inner region, the charge having centering abutments formed therein, the charge top wall having a flexible membrane, the charge top wall having a depending activation post thereon, the charge top wall being flexible so as to urge the activation post into the charge inner region, the charge top wall and the housing lid being aligned with one another;

a charge lid sealable to the charge side walls to seal the charge and enclose the inner region;

a sealed, frangible ampoule disposed in the charge between the centering abutments, the charge lid, and the top wall;

a first chemical disposed in the charge, outside of the ampoule; and a second chemical disposed in the ampoule, wherein pressure applied to the housing lid urges the housing lid into contact with the charge top wall and wherein continued pressure on the housing lid urges the charge top wall inward of the charge inner region to move the activation post into contact with the ampoule to break the ampoule to allow the first and second chemicals to mix to provide a chemiluminescent lighting effect, and wherein after activation, the chemicals are maintained within the sealed charge.

2. The chemiluminescent novelty device in accordance with claim 1 wherein a heat seal is disposed between the housing lid and the housing side walls.

3. The chemiluminescent novelty device in accordance with claim 1 wherein an ultrasonic seal is disposed between the housing lid and the housing side walls.

4. The chemiluminescent novelty device in accordance with claim 1 wherein an adhesive is disposed between the housing lid and the housing side walls.

5. The chemiluminescent novelty device in accordance with claim 1 wherein a heat seal is disposed between the charge lid and the charge side walls.

6. The chemiluminescent novelty device in accordance with claim 1 wherein an ultrasonic seal is disposed between the charge lid and the charge side walls.

7. The chemiluminescent novelty device in accordance with claim 1 wherein an adhesive is disposed between the charge lid and the charge side walls.

8. The chemiluminescent novelty device in accordance with claim 1 wherein the housing lid flexible membrane is formed with a living hinge.

9. The chemiluminescent novelty device in accordance with claim 1 wherein the charge lid flexible membrane is formed with a living hinge.

10. The chemiluminescent novelty device in accordance with claim 1 wherein the charge abutments are formed integral with the charge side walls and bottom wall.

11. The chemiluminescent novelty device in accordance with claim 1 wherein the housing lid flexible membrane is formed integral with the housing lid.

12. The chemiluminescent novelty device in accordance with claim 1 wherein the charge top wall flexible membrane is formed integral with the top wall and the charge body.

13. The chemiluminescent novelty device in accordance with claim 1 wherein the charge lid is formed having a generally U-shaped profile defining free ends of the lid, and wherein the free ends define feet to space the charge from the housing bottom wall.

14. The chemiluminescent novelty device in accordance with claim 1 wherein the housing lid plunger and the charge top wall activation post are aligned with one another to communicate pressure on the housing lid flexible membrane to the frangible ampoule.

15. A sealed, chemiluminescent novelty device, comprising:

a sealed outer housing having side walls and a bottom wall formed as a unitary member to define a housing inner region and a housing lid sealable to the housing side walls, the housing lid having a flexible membrane with a having a depending plunger thereon;

a sealed charge having side walls and a top wall formed as a unitary member to define a charge inner region and having centering abutments formed therein, the charge top wall having a flexible membrane having a depending activation post thereon, the charge top wall and the housing lid being aligned with one another, the charge including a charge lid sealed to the charge side walls to seal the charge;

a sealed, frangible ampoule disposed in the charge between the centering abutments, the charge lid, and the top wall, the sealed ampoule containing one chemical of a mixture of chemicals; and another chemical of the mixture of chemicals disposed in the charge segregated from the other of the chemicals by the ampoule;

wherein pressure applied to the housing lid urges the housing lid into contact with the charge top wall to contact the ampoule to break the ampoule to allow the chemicals to mix to provide a chemiluminescent lighting effect, and wherein after activation, the chemicals are maintained within the sealed charge.

16. The chemiluminescent novelty device in accordance with claim 15 wherein the housing lid and the charge top wall include members aligned with one another to communicate a pressure on the housing lid flexible membrane to the frangible ampoule,

17. The chemiluminescent novelty device in accordance with claim 15 wherein the housing lid flexible membrane is formed integral with the housing lid.

18. The chemiluminescent novelty device in accordance with claim 15 wherein the charge top wall flexible membrane is turned integral with the top wall and the charge body.

19. The chemiluminescent novelty device in accordance with claim 15 wherein the charge lid is formed having a generally U-shaped profile defining free ends of the lid, and wherein the free ends define feet to space the charge from the housing bottom wall.

20. The chemiluminescent novelty device in accordance with claim 15 wherein the device is a beverage accessory device having a shape resembling an ice cube.

* * * * *